US005861365A

United States Patent [19]

Colurciello, Jr. et al.

[11] Patent Number: 5,861,365

[45] Date of Patent: Jan. 19, 1999

[54] AEROSOL, AQUEOUS CLEANING COMPOSITIONS PROVIDING WATER AND OIL REPELLENCY TO FIBER SUBSTRATES

[75] Inventors: Andrew Francis Colurciello, Jr., Newburgh, N.Y.; Tracy Ann Ryan, Rivervale, N.J.; Jeanne Marie Weller, Glen Rock, N.J.; Michael Richard Tyerech, Fort Lee, N.J.; Robert Thomas Delaney, Bloomingdale, N.J.

[73] Assignee: Reckitt & Colman Inc., Wayne, N.J.

[21] Appl. No.: 724,440

[22] Filed: Oct. 1, 1996

[30] Foreign Application Priority Data

Jul. 27, 1996 [GB] United Kingdom ..... 9615821

[51] Int. Cl.[6] ..... D06M 15/277; D06M 15/53; D06M 15/233; D06M 15/263

[52] U.S. Cl. ..... 510/278; 510/280; 510/475

[58] Field of Search ..... 510/278, 280, 510/475

[56] References Cited

U.S. PATENT DOCUMENTS

| | | | |
|---|---|---|---|
| 3,901,727 | 8/1975 | Loudas | 134/4 |
| 4,566,981 | 1/1986 | Howells | 252/8.8 |
| 4,668,726 | 5/1987 | Howels | 524/225 |
| 5,202,049 | 4/1993 | Bingham | 252/162 |
| 5,370,919 | 12/1994 | Fieuws et al. | 428/96 |

FOREIGN PATENT DOCUMENTS

| | | | |
|---|---|---|---|
| 1323819 | 11/1993 | Canada | C11D 09/02 |
| 0 648 834 A1 | 4/1995 | European Pat. Off. | C11D 1/83 |
| WO93/01348 A1 | 1/1993 | WIPO . | |
| WO95/34631 | 12/1995 | WIPO | C11D 3/39 |
| 0 803 567 A2 | 10/1997 | WIPO | C11D 1/00 |

OTHER PUBLICATIONS

WPI Abstract Acc No: 85–034494/06 and JP 59228076 A

Copy of GB Search Report for Application No. GB 9615180.8 dated 4 Nov. 1996.

Copy of GB Search Report for Application No. GB9615821.7 dated 7 Nov. 1996.

Copy of GB Search Report for Application No. GB9608503.0 dated 10 Jul. 1996.

Copy of PCT International Search Report for PCT Application No. PCT/US97/11838 dated 30 Jan. 1998.

*Primary Examiner*—Bernard Lipman
*Assistant Examiner*—N. Sarofin
*Attorney, Agent, or Firm*—Fish & Richardson P.C.

[57] ABSTRACT

Aqueous cleaning and surface treatment compositions for imparting oil and water repellency to treated surfaces which comprise:

(a) fluoroaliphatic radical-containing poly(oxyalkylene) compound;

(b) anti-resoiling composition;

(c) anionic surfactant compound, preferably one or more selected from alkyl sulfates, alkyl benzene sulfates, and alkane sulfonates as well as salts thereof;

(d) organic solvent;

(e) citric acid salts, preferably one or more anhydrous and dihydrous sodium citrates (f) water wherein the are at a neutral or alkaline pH, especially from about 8 to about 10. The compositions are particularly shelf stable, and exhibit excellent shelf stability in pressurized aerosol containers.

23 Claims, No Drawings

AEROSOL, AQUEOUS CLEANING COMPOSITIONS PROVIDING WATER AND OIL REPELLENCY TO FIBER SUBSTRATES

The present invention relates to aqueous cleaning compositions which clean, as well as provide water and oil repellency to fibers and fiber substrates, and which are especially suitable in aerosol preparations. More particularly the present invention relates to aerosol, aqueous cleaning compositions which include fluorosurfactants and which provide oil and water repellency to carpet fibers treated with the compositions which are particularly suitable for dispensation from a pressurized container or other dispense and which are particularly suitable for cleaning carpets and carpet fibers. These compositions farther impart water and oil repellent properties to the treated fiber substrates, particularly carpets.

Textile substrates, particularly carpets and carpeted surfaces are commonly encountered in both domestic, commercial and public environments. Carpets provide a pleasant surface covering, especially floor surfaces, and in some cases, wall surfaces which are durable, help deaden sound transmission, are in some part thermally insulating, and are readily applied. In order to retain their attractive appearance, such carpet surfaces require maintenance, particularly cleaning. Such cleaning may be of a general nature such as by vacuuming, wherein loose particulates are withdrawn from said carpet surface, as well as more intensive cleaning operations, including general shampooing and cleaning, as well as spot cleaning where a limited area or locus surrounding a stain is treated in order to remove it.

The consequence of such intensive cleaning operations is very frequently the reduction or removal of anti-staining characteristics which may have been imparted to the carpet fiber at the time of its production, such as by treatment by a wide variety of known compounds. The purpose of such compounds, and such carpet treatment compositions is to provide the carpet fibers with a degree of repellency, particularly to oil and water. Both oil and water, jointly and severally, are major constituents in a wide variety of staining materials, such as: beverages, food stuffs, as well as other edible and/or imbibable compositions. Further staining compositions include any variety number of other materials which may come into contact with the carpet and which are entrained amongst the carpet fibers and/or upon the carpet fiber surface. Unfortunately, such carpet fiber treatments and treatment compositions when applied frequently wear away with time due to the normal wear and tear associated with such an installed carpet surface, and/or may be deleteriously degraded and/or removed by one or more chemicals or other compositions which may be used in the intensive cleaning of a carpet surface.

Australian Patent No. AU-A-42875/89 describes an aqueous carpet cleaning compositions which includes a small amount of a perfluoropropionate and a perfluoroalkyl phosphate as well as mixtures thereof, a small amount of a nonionic, anionic or amphoteric surfactant or mixture thereof, a pH adjusting agent, and water, as well as minor amounts of other conventional additives.

GB Patent No. 2,200,365-A describes a detergent composition which can be used in cleaning soiled carpet surfaces which includes between 0.01–50% by weight of a silicone or siloxane compound in conjunction with a 50% and greater proportion of one or more conventional surfactants.

U.S. Pat. No. 4,279,796 describes a carpet cleaning composition as well as a specific process for its application which carpet cleaning composition is an aqueous dispersion containing a non-fluorinated vinyl polymer, a perfluoroalkyl ester of carboxylic acid, and hydrogen peroxide.

U.S. Reissue Pat. No. 30,337 as well as U.S. Pat. No. 4,043,923 describes cleaning and treatment compositions which may be used for the treatment of amongst other substrates, carpet surfaces. Compositions described therein include as an essential constituent certain novel detergent compatible organic fluorochemical compounds which are described as being useful in otherwise conventional cleaning compositions containing anionic or nonionic surface active agents which are used as detersive constituents. These particular fluorochemical compounds are recited as imparting both oil repellency and water repellency to treated carpet samples.

U.S. Pat. No. 4,145,303 and U.S. Pat. No. 3,901,727 both to Loudas describes a water dilutable alkaline cleaning composition which includes amongst its constituents at least one zinc or zirconium coordination complex which is water dispersible and capable of combining with substantially all of the acid radicals which are otherwise present in the composition, as well as up to about 1.5 parts of at least one fluorochemical compound having acid functionality which fluorochemical compound is capable of imparting water and oil repellency to the substrate.

U.S. Pat. No. 5,370,919 to Fieuws describes a composition effective for imparting water and oil repellency as well as stain resistance and dry soil resistance to textiles, carpets, as well as other substrates which contains a fluoroaliphatic radical containing a polyoxyalkylene compound, an anti-soiling agent, and up to 60% by weight of an environmentally acceptable water miscible organic solvent as well as water.

U.S. Pat. No. 5,439,610 to Ryan et al, discloses aqueous cleaning compositions which include sodium lauryl sulfate, ethylene glycol monohexyl ether, a flurosurfactant, a carboxylated polymer salt and tetrasodium ethylenediamine tetraacetate in specific weight ranges. The said cleaning compositions are recited to be useful cleaners for carpet surfaces, and to provide an oil repellent characteristic thereto.

While the prior art has proposed many such cleaning compositions, they have not uniformly met with success. Accordingly there remains a real and continuing need in the art for the provision of improved cleaning compositions, particularly cleaning compositions useful in the cleaning of carpet fibers and carpet surfaces. There is a further need in the art for improved carpet cleaning compositions which impart both water repellency and/or repellency to carpet fibers and carpet surfaces treated with such a composition.

Accordingly certain deficiencies of such prior art compositions are addressed and overcome by the present invention which provide aqueous cleaning and surface treatment compositions for imparting oil and water repellency to treated surfaces which comprise the following constituents:

(a) fluoroaliphatic radical-containing poly(oxyalkylene) compound;

(b) anti-resoiling composition;

(c) anionic surfactant compound, preferably one or more selected from alkyl sulfates, alkyl benzene sulfates, and alkane sulfonates as well as salts thereof;

(d) organic solvent;

(e) citric acid salts, preferably one or more anhydrous and dihydrous sodium citrates (f) water The compositions of the invention are at a neutral or alkaline pH, desirably at a pH in the range of from 7 to 10, and desirably do not contain salts of alkaline diamine tetraacetic acid, especially ethylene diamine tetraacetic acid salts. The compositions impart good water and oil repellent properties to treated carpet surfaces, and are shelf stable when packaged into pressurized aerosol containers. The compositions according to the invention may optionally, but in some cases desirably include one or more additives selected from:

(g) preservatives, coloring agents such as dyes and pigments, fragrances, pH adjusting agents, buffer compositions, further anti-soiling agents and resoiling inhibitors, optical brighteners, further solvents or surfactants especially non-ionic surfactant compounds, as well as one or more further fluorosurfactant compositions.

These aqueous compositions are efficacious cleaning compositions which provide not only a cleaning benefit to treated surfaces, particularly to carpeted surfaces and carpet fibers but which also impart both water and oil repellency to treated substrates. These aqueous compositions are alkaline in nature, having a pH of at least about 8. Further, these aqueous compositions are particularly useful in aerosol containers, as well as in manually pumpable dispensing devices.

The compositions according to the invention exhibit excellent shelf stability, particulary when packaged in conventional pressurized aerosol containers and subjected to accelerated ageing testing at 120 deg. F., for a four-week test period. Compositions subjected to such a test were observed to be phase stable, and little or no corrosion of the interior of the pressurized aerosol containers were observed.

The fluoroaliphatic radical-containing poly(oxyalkylene) compound of constituent (a) is a fluoroaliphatic oligomer or polymer (the term "oligomer" hereinafter includes polymer unless otherwise indicated) which may be represented by the general formule:

$$(R_f)_sZ[(R^3)_yZ'B]_t \quad (1)$$

$$[(R_f)_sZ[(R^3)_yZ'B']_t]_w \quad (2)$$

where $R_f$ is a fluoroaliphatic radical,

Z is a linkage through which $R_f$ and $(R^3)_y$ moieties are covalently bonded together, $(R^3)_y$ is a poly(oxyalkylene) moiety, $R^3$ being an oxyalkylene group with 2 to 4 carbon atoms and y is an integer (where the above formulas are those of individual compounds) or a number (where the above formulas are those of mixtures) at least 1, preferably 1 to 125 and can be as high as 180 or higher, B is a hydrogen atom or a monovalent terminal organic radical, B' is B or a valence bond, with the proviso that at least one B' is a valence bond interconnecting a Z-bonded $R^3$ radical to another Z, Z' is a linkage through which B, or B', and $R^3$ are covalently bonded together, s is an integer or number of at least 1 and can be as high as 25 or higher, t is an integer or number of at least 1, and can be as high as 60 or higher, and w is an integer or number greater than 1, and can be as high as 30 or higher.

In formulas (1) and (2), where there were a plurality of $R_f$ radicals, these may be either the same or different. This also applies to a plurality of Z, Z', $R^3$, B, B', and, in formula (2), a plurality of s, y and t.

$R_f$ is a stable, inert, nonpolar, preferably saturated monovalent moiety which is both oleophobic and hydrophobic. A fluorinated oligomer preferably comprises from 1 to about 25 $R_f$ groups and preferably comprises about 5 percent to about 30 percent, and more preferably about 8 percent to about 20 percent fluorine by weight based on the total weight of the oligomer, the loci of the fluorine being essentially in the $R_f$ groups. $R_f$ preferably contains at least about 3 carbon atoms, more preferably 3 to about 20 carbon atoms, and most preferably about 6 to about 12 carbon atoms. $R_f$ can contain straight chain, branched chain, or cyclic alkyl groups. $R_f$ is preferably free of polymerizable olefinic unsaturation and can optionally contain caternary heteroatoms such as oxygen, divalent or hexavalent sulfur, or nitrogen. It is preferred that each $R_f$ contain about 40% to about 78% fluorine by weight, more preferably about 50% to about 78% fluorine by weight. The terminal portion of the $R_f$ group contains a fully fluorinated terminal group. This terminal group preferably contains at least 7 fluorine atoms, e.g., $CF_3CF_2CF_2$; $(CF_3)_2CF$; $CF_2SF_5$, or the like.

Perfluorinated aliphatic groups, i.e., those of the formula $C_nF_{2n+1}$, are the most preferred embodiments of $R_f$.

Generally, the oligomers will contain about 5 to 40 weight percent, preferably about 10 to 30 weight percent, of carbon-bonded fluorine.

In the poly(oxyalkylene) radical, $(R^3)_y$, $R^3$ is an oxyalkylene group having 2 to 4 carbon atoms, such as —$OCH_2CH_2$—, —$OCH_2CH_2CH_2$—, —$OCH(CH_3)CH_2$—, and —$OCH(CH_3)CH(CH_3)$—, the oxyalkylene units in said poly(oxyalkylene) being the same, as in poly (oxypropylene), or present as a mixture, as in a heteric straight or branched chain or randomly distributed oxyethylene and oxypropylene units or as in a straight or branched chain of blocks of oxyethylene units and blocks of oxypropylene units. The poly(oxyalkylene) chain can be interrupted by or include one or more catenary linkages. Where said catenary linkages have three or more valences, they provide a means for obtaining a branched chain of blocks of oxyalkylene units. The poly(oxyalkylene) radicals in the oligomers can be the same or different, and they can be pendent. The molecular weight of the poly(oxyalkylene) radical can be about 500 to 2,500 and higher, e.g., 100,000 to 200,000 or higher.

The function of the linkages Z and Z' is to covalently bond the fluoroaliphatic radicals, $R_f$, the poly(oxyalkylene moieties, $(R^3)_y$ and radicals B and B' together in the oligomer. Z and Z' can be a valence bond, for example, where a carbon atom of a fluoroaliphatic radical is bonded or linked directly to a carbon atom of the poly(oxyalkylene) moiety. Z and Z' each can also comprise one or more linking groups such as polyvalent aliphatic and polyvalent aromatic, oxy, thio, carbonyl, sulfone, sulfoxy, phosphoxy, amine, and combinations thereof, such as oxyalkylene, iminoalkylene, imimoarylene, sulfonamido, carbonamido, sulfonamidoalkylene, carbonamidoalkylene, urethane, urea, and ester. The linkages Z and Z' for a specific oligomer will be dictated by the ease of preparation of such an oligomer and the availability of necessary precursors thereof.

Illustrative linking groups Z are alkylene groups, such as ethylene, isobutylene, hexylene, and methylenedicyclohexylene, having 2 to about 20 carbon atoms, aralkylene groups, such as

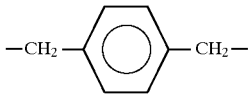

and

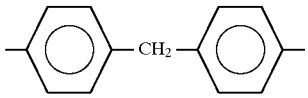

having up to 20 carbon atoms, arylene groups, such as tolylene, —$C_6H_3(CH_3)$—, poly(oxyalkylene) groups, such as —$(C_2H_4O)_yC_2H_4$— where y is 1 to about 5, and various combinations of these groups. Such groups can also include other hetero moieties (besides —O—), including —S— and —N—. However, Z is preferably free of groups with active hydrogen atoms.

From the above description of Z and Z' it is apparent that these linkages can have a wide variety of structures, and in fact where either is a valence bond, it does not even exist as a structure. However large Z or Z' is, the fluorine content (the locus of which is $R_f$) is in the aforementioned limits set forth in the above description, and in general the total Z and Z' content of the oligomer is preferably less than 10 weight percent of the oligomer.

The monovalent terminal organic radical, B, is one which is covalently bonded through Z', to the poly(oxyalkylene) radical.

Though the nature of B can vary, it preferably is such that it complements the poly(oxyalkylene) moiety in maintaining or establishing the desired solubility of the oxyalkylene. The radical B can be a hydrogen atom, an acyl radical such as $C_6H_5C(O)$—, an alkyl radical, preferably lower alkyl, such as methyl, hydroxyethyl, hydroxypropyl, mercaptoethyl and aminoethyl, or an aryl radical, such as phenyl, chlorophenyl, methoxyphenyl, nonylphenyl, hydroxphenyl, and aminophenyl. Generally, Z'B will be less than 50 weight percent of the $(R^3)_yZ'B$ moiety.

The fluoroaliphatic radical-containing poly(oxyalkylene) compounds used in the compositions according to the present invention can be prepared by a variety of known methods, such as by condensation, free radical, or ionic homopolymerization or copolymerization using solution, suspension, or bulk polymerization techniques, e.g., see "Preparative Methods of Polymer Chemistry", Sorenson and Campbell, 2nd ed., Interscience Publishers.

The fluoroaliphatic radical-containing poly(oxyalkylene) compounds are commercially available.

In one preferred embodiment of the invention the fluoroaliphatic radical-containing poly(oxyalkylene) compound contains a fluoroalkyl radical having 3 to 20 carbon atoms, wherein perfluoroalkyl radicals are particularly preferred.

In a further preferred embodiment the fluoroaliphatic radical-containing poly(oxyalkylene) compound can contain 1 to 15, but more preferably 1–2, and most preferably an average of about 1.5 ethylene and/or propylene radicals per molecule of the fluoroaliphatic radical-containing poly (oxyalkylene) compound.

A particularly advantageous fluoroaliphatic radical-containing poly(oxyalkylene) compound which may be used as constituent (a) of the present invention is one which is presently commercially available as FLUORAD® FC-138 from the Minnesota Mining and Manufacturing Co. (St. Paul, Minn.) which is described as being a composition consisting essentially of: 37% wt. water, 27% wt. of the fluorochemical salt, 18% wt. of isopropyl alcohol, and 18% wt. of 2-butoxyethanol. While not wishing to be bound to the following representation, it is believed that this advantageous fluoroaliphatic radical-containing poly(oxyalkylene) compound is a fluorochemical salt is extremely similar to or which may be represented by the following general structure:

$$C_8F_{17}N(CH_3)(CH_2)_3(A)_nOSO_2^-X^+$$

in which n represents a value of between 1 and 3, preferably is a value of from 1 to 2 inclusive, and most preferably is a value of about 1.5;

A represents an ethoxy ($OC_2H_4$), propoxy ($OC_3H_6$) or a mixture of both, but preferably represents ethoxy;

$X^+$ is a salt forming counterion such as an alkali or alkaline earth metal counterion.

Useful fluoroaliphatic radical-containing poly (oxyalkylene) compounds which find use in the compositions of the invention include those which are described or referenced in U.S. Pat. No. 5,370,919 to Fiews et al., the contents of which are herein incorporated by reference.

This fluoroaliphatic radical-containing poly(oxyalkylene) compound according to constituent (a) is included in the compositions of the invention in amounts of from between about 0.001% wt. to about 3% wt.; more desirably the fluoroaliphatic radical-containing poly(oxyalkylene) compound is present in an amount of from 0.05% wt. to about 2.0% wt. based on the total weight of the composition. Most preferably constituent (a) is present in an amount sufficient to provide the fluoroaliphatic radical-containing poly (oxyalkylene) compound in an amount of from about 1.4% wt. to 2.0% wt in the compositons of the invention. It is understood that fluoroaliphatic radical-containing poly (oxyalkylene) compound, may be provided with further constituents, such as water, as well as one or more surfactants in a commercially available preparations.

The compositions according to the invention most desirably further comprise minor amounts of one or more anti-resoiling compositions as constituent (b). These anti-resoiling compositions include those known to the art to inhibit the resoiling of treated carpet fibers and carpet surfaces. Such compositions include for example, colloidal silica, aluminum oxides, styrene-maleic anhydride copolymer resins, polyvinylpyrrolidone, polyacrylates, polycarboxylates, modified cellulose polymers, vinyl acetate/maleic anhydride copolymer resins, cationic amines, aliphatic quaternary ammonium salts known to have anti-static properties, imidazoline salts as well as others known to the art. Such resoiling inhibitors may be added in amounts of from about 0.00001 to about 5.0% wt., but are desirably included in amounts of from 0.01% wt–1.5% wt.

One particularly desirable anti-resoiling composition which may be used in constituent (b) of the present inventive compositions are fluorinated acrylic polymers; the inclusion of such fluorinated acrylic polymers and salts in the compositions of the invention improve the resoiling resistance of fibrous substrates treated with said compositions. A specific and preferred fluorinated acrylate copolymer according to the formula:

$$CF_3(CF_2)_nCH_2OCOC(CH_3)=CH_2$$

wherein n represents a value of from 6–8.

This fluorinated acrylate copolymer may be generally characterized by a total fluorine content based on polymer solids of approximately 0.6 percent. This fluorinated acrylate copolymer may also may contain a zinc complex to act as a crosslinker. The number average (Mn) and weight average (Mw) molecular weights are generally in the range of approximately 9,000 and approximately 10,500 respectively. Such a fluorinated acrylate copolymer may be obtained commercially as a water based dispersion of approximately 76–77 weight % water; 18–19 weight % acrylate copolymer; 1 weight % nonylphenoxypolyethoxyethanol; 1 weight % sodium lauryl sulfate; and 1 weight % zinc oxide complex (with said weight % of the ingredients based on the total weight of the water dispersion), as SYNTRAN® 1575 (Interpolymer Corporation, Canton, Mass.). When this SYNTRAN® 1575 composition is employed, preferably it is present in an amount which ranges from about 0.10 weight % to about 11.0 weight % of the total composition, which correspondingly equals 0.00018% wt. to 1.98 weight % wt. of the fluorinated acrylate copolymer. More preferably this SYNTRAN® 1575 composition is present an amount of about 5.55% wt. to about 8.0% wt., which correspondingly equals approximately 0.99% wt. to 1.44% wt. of the fluorinated acrylate copolymer. Most preferably, this SYNTRAN® 1575 composition is present in an amount of about 6.0% wt., which corresponds to approximately 1% wt. of the fluorinated acrylate copolymer.

One further particularly desirable anti-resoiling composition which may be used in constituent (b) of the present inventive compositions is a non-halogenated acrylic polymer which may be represented by the formula:

$$\left(CH_2-CH(COOR)\right)_n$$

wherein n is a value greater than 50.

Such a non-halogenated acrylic polymer is presently commercially available and may be obtained as in commercial preparations as an aqueous dispersion which includes 78–79% wt. water, 18–19% wt. of the non-halogenated acrylic polymer, 1% wt. of sodium lauryl sulfate, 1% wt. sodium nonylphenoxypolyethoxyethanol sulfate, and 1% wt. zinc oxide complex as SYNTRAN® 1580, as well as an aqueous dispersion which includes 74–75% wt. water, 23–24% wt. of the non-halogenated acrylic polymer, 1% wt. of sodium mono-alkylarylpolyethoxy sulfosuccinate, and 1% wt. sodium lauryl sulfate sulfate as SYNTRAN® 1588. These materials are considered to be infinitely miscible in water by the manufacturer, and the former is provided as an aqueous dispersion having a pH of 8.3 to 9.3, and the latter is provided as an aqueous dispersion having a pH of 7.7 to 8.7. Both of these materials may be obtained from Interpolymer Corporation (Canton, Mass.). Desirably, such a commercial preparation containing a non-halogenated acrylic polymer of constituent (b) may be included in the present inventive compositions in an amount of from 0.001–10% wt., which corresponds to about from 0.000018% wt. to about 0.5% wt. of the non-halogenated acrylic polymer. Desirably this commercial preparation is present in amounts of from 0.56% wt–8.35% wt., which corresponds to from about 0.1% wt. to about 2.0% wt. of the non-halogenated acrylic polymer. Most desirably the commercial preparation is included in amounts of from 4.5% wt.–6.25% wt. based on the total weight of the commerical preparation, which corresponds to a weight of from about 0.80% wt. to about 1.50% wt. of the non-halogenated acrylic polymer and/or salt thereof.

A wide variety of known anionic surfactants may be included in the present inventive compositions as constituent (c). Such known useful anionic surfactants include organic sulfuric reaction products having in their molecular structure an alkyl group containing from about 8 to about 20 carbon atoms and a sulfonic acid or sulfuric acid ester group. Included in the term "alkyl" is the alkyl portion of aryl groups. These include but are not limited to: alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkylpolyglycosides, diphenyl sulfonate derivatives, alkyl phosphates, alkyl ether phosphates, acyl sarconsinates, acyl isethionates, and N-acyl taurates. Generally, the alkyl or acyl radical in these various compounds comprise a carbon chain containing 8 to 20 carbon atoms, and preferably comprise a carbon chain containing 12 to 20 carbon atoms. The alkyl or acyl radical may be linear or branched. Mixtures of two or more anionic surfactants may be used as well.

Further exemplary anionic surfactants which may be used include fatty acid salts, including salts of oleic, ricinoleic, palmitic, and stearic acids; copra oils or hydrogenated copra oil acid, and acyl lactylates whose acyl radical contains 8 to 20 carbon atoms.

Other anionic surfactants not particularly enumerated here may also find use in conjunction with the compounds of the present invention.

Especially preferred anionic surfactant constituents are alkyl sulfates, alkyl benzene sulfates, and alkane sulfonates, sulfosuccinates and sulfosuccinate derivatives of which water soluble forms, and water soluble salts thereof are especially preferred, and especially preferred those containing from 11 to 17 carbon atoms in their alkyl radical, which may be straight chained or branched. Useful water soluble salts which are effective in producing salt forms of the surfactant include, but are not limited to: sodium, potassium, ammonium, magnesium and mono-, di- and tri- $C_2$–$C_3$ alcohol ammoniums, amine and aminoalcohol salts forms. Preferably, however, the salts are selected from sodium, magnesium and ammonium. Such preferred anionic surfactant compositions are per se known, and may be obtained from a variety of sources.

Exemplary and preferred, commercially available alkyl sulfates surfactants include one or more of those available under the tradename RHODAPON® LCP from Rhône-Poulenc Co. as well as STEPANOL® from Stepan Chemical Co. Exemplary alkyl sulfates which is preferred for use is a sodium lauryl sulfate surfactant presently commercially available as RHODAPON® LCP from Rhône-Poulenc Co., and further a sodium lauryl sulfate surfactant composition having less than about 0.05% wt of chlorides which is presently commercially available as STEPANOL® WAC from Stepan Chemical Co.

Exemplary and preferred, commercially available alkyl benzene sulfate surfactants include one or more of those available under the tradename BIOSOFT® from Stepan Chem. Co. An exemplary alkyl benzene sulfates which is preferred for use is a sodium dodecyl benzene sulfonate surfactant presently commercially available as BIOSOFT® D-40 from Stepan Chem. Co.

Exemplary and preferred, commercially available alkane sulfonate surfactants include one or more of those available under the tradename HOSTAPUR® from Hoechst Celanese. An exemplary alkane sulfonate which is preferred for use is a secondary sodium alkane sulfonate surfactant presently commercially available as HOSTAPUR® SAS from Hoechst Celanese.

Further exemplary and preferred anionic surfactants based on sulfosuccinates include those which are presently commercially available under the tradename ALKASURF® from Rhone-Poulenc Surfactant & Specialty Division. By way of illustrative example, these include the following: ALKASURF SS-MA-80, which is described to be a sodium dihexyl sulfosuccinate, ALKASURF SS-NO, which is described to be tetrasodium N-alkyl sulfosuccinamate, ALKASURF SS-O, which is described to be sodium dioctyl sulfosuccinate, ALKASURF SS-OA-HE described to be a disodium oleyl amido polyethyleneglycol-2 sulfosuccinate, ALKASURF SS-TA, disclosed as being sodium N-octadecyl sulfosuccinamate, ALKASURF SS-L7DE, which is described as being a sodium sulfosuccinate ester of lauric diethanolamide, ALKASURF SS-L9ME, which is described as being a sodium sulfosuccinate ester of lauric monoethanolamide, ALKASURF SS-L-HE, which is disclosed to be disodium lauryl sulfosuccinate. Further exemplary and preferred anionic surfactants based on sulfosuccinates include those which are presently commercially available under the tradename MACKANATE® from the McIntyre Group Ltd. By way of illustrative example these include: MACKANATE CM described to be coconut sulfosucinate, MACKANATE CM-100 described to be disodium cocoamido MEA sulfosuccinate, MACKANATE CP described to be disodium cocoamide methylisopropanolamide sulfosuccinate, MACKANATE DOS 70M5 described to be sodium dioctyl sulfosuccinate, MACKANATE DOS-75 described to be sodium dioctyl sulfosuccinate, MACKANATE EL described to be lauryl ether sulfosuccinate, MACKANATE L descrbed to be disodium laureth sulfosuccinate, MACKANATE LM-40 described to be lauric sulfosuccinate, MACKANATE LO described to be sodium lauryl sulfosuccinate; MACKANATE OD-2 described to be blended sulfosuccinates; MACKANATE OM described to be oleic sulfosuccinate; MACKANATE OP described to be disodium oleamide MIPA sulfosuccinate, MACKANATE RM described to be ricinoleic sulfosucinate, MACKANATE TDS described to be disodium tridecyl sulfosuccinate.

It is to be understood that mixtures or blends of two or more anionic surfactants as described above may form the anionic surfactant according to constituent (c).

Further desirably the anionic surfactant according to constituent (c) is selected to be of a type which dries to a friable powder. Such a characteristic facilitates the subsequent removal of such anionic surfactants from a fibrous substrate, especially carpets and carpet fibers, such as by brushing or vacuuming. Particularly preferred aninoic surfactants are exemplified in the Examples, below.

The anionic surfactant according to constituent (c) may be included in the present inventive compositions in an amount of from 0.001% wt.–2.5% wt., but are desirably included in amounts of from 0.1% wt–2.0% wt., even more desirably are included in amounts of from 0.5% wt.–1.5% wt., and most desirably are included in amounts of from 0.75% wt.–1.2% wt. with such recited weights being based on the anionic surfactant compound(s) present in an anionic surfactant containing composition or preparation.

The organic solvent constituents which form constituent (d) of the inventive compositions include one or more alcohols, glycols, acetates, ether acetates and glycol ethers. Exemplary alcohols useful in the compositions of the invention include $C_3$–$C_8$ alcohols which may be straight chained or branched, and which are specifically intended to include both primary and secondary alcohols. Exemplary glycol ethers include those glycol ethers having the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Preferred are glycol ethers having one to five glycol monomer units. These are $C_3$–$C_{20}$ glycol ethers.

By way of further non-limiting example specific organic constituents useful as constituent (d) include propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particularly advantageously ethylene glycol hexyl ether, diethylene glycol hexyl ether, as well as the $C_3$–$C_8$ primary and secondary alcohols, especially isopropyl alcohol.

Particuarly useful as constituent (d) include organic solvents as are presently commercially available under the tradenames CARBITOL® (Union Carbide Corp., Danbury, Conn.), CELLOSOLVE® (Union Carbide Corp., Danbury, Conn.), DOWANOL® (Dow Chemical Co., Midland, Mich.) and ARCOSOLV® (ARCO Chemical Co., Newton Square, Pa.). Particularly useful are those organic solvents which are illustrated in the Examples as well as: DOWANOL® DB, diethylene glycol n-butyl ether; DOWANOL® PNP, propylene glycol n-propyl ether; DOWANOL® DPNP, dipropylene glycol n-propyl ether; DOWANOL® PNB, propylene glycol n-butyl ether and DOWANOL® DPNB, dipropylene glycol n-butyl ether. Also particularly useful are ARCOSOLV® PNP, ARCOSOLV® DPNP, ARCOSOLV® PNB and ARCOSOLV® DPNB.

The inventors have found that mixtures of two or more individual organic solvent constituents imparts the benefit of both good cleaning and soil penetration and at the same time effective solubilization of the fluorochemical surfactant composition in the aqueous compositions according to the invention. This has been observed particularly wherein one or more of the solvents which form the organic solvent constituent is relatively hydrophobic, and/or includes a $C_3$–$C_8$, but preferably a $C_5$–$C_7$ carbon chain which has been observed to adequately penetrate oily soils. One such preferred mixture of organic solvents includes an organic solvent system which includes both at least one glycol ether with at least one $C_3$–$C_8$ primary or secondary alcohol, for example ethylene glycol hexyl ether with isopropanol; diethylene glycol methyl ether with isopropanol; as well as ethylene glycol hexyl ether with 1-pentanol. A further preferred organic solvent system includes a mixture of two different glycol ethers, optionally further in conjunction with at least one a $C_3$–$C_8$ primary or secondary alcohol. Examples of such an organic solvent system include ethylene glycol hexyl ether in conjunction with diethylene glycol hexyl ether and optionally further with at least one a $C_3$–$C_8$ primary or secondary alcohol. In such organic solvent systems, the ratio of the ethylene glycol hexyl ether to diethylene glycol hexyl ether is limited to 1:0.1–1, but more desirably is limited to 1:0.15–0.5. A particularly advantageous organic solvent is ethylene glycol hexyl ether with diethylene glycol hexyl ether in a weight ratio of 1:0.1–1, which optionally includes one or more $C_3$–$C_8$ primary or secondary alcohols.

The organic solvent system according to constituent (d) is present in amounts of from about 0.001% wt. to about 7.0% wt. More desirably the organic solvent constituent is present in an amount of from about 0.25% wt. to about 5% wt., more desirably is present in an amount of from 2.0% wt. to 4.0% wt. and most desirably is present in an amount of about 3.25% of the inventive compositions.

The compositions according to the invention include as constituent (e) citric acid salts, preferably one or more anhydrous and/or dihydrous forms of citric acid metal salts. Virtually any alkaline earth metal or alkaline metal may be used as the salt forming metal cation, but sodium and potassium are generally to be preferred as being effective in the inventive compositions, and widely available at a low cost. The inventors have found that the the presence of such materials, particularly in the amounts recited below aid in the phase stability of the compositions, and are believed to contribute to the long term or shelf stability of the inventive compositions especially when said the compositions are packaged in conventional pressurized aerosol containers. At the same time, these citric acid salts, particularly when provided in an anhydrous (or dihydrous) citric acid sodium salt form have been observed to contribute little or no appreciable corrosive effects to such conventional pressurized aerosol containers. These anhydrous citric acid sodium salts have also been observed to be compatible with anti-corrosion agents such as sodium nitrite and sodium benzoate which are desirably included in the inventive compositions to resist corrosion of the conventional pressurized aerosol containers. Desirably the citric acid salts, preferably one or more anhydrous and/or dihydrous forms of citric acid metal salts according to constituent (e) are present in amounts of from 0.01 to 0.3% wt. based on the total weight of the composition.

As is noted above, the compositions according to the invention are aqueous in nature. Water forms constituent (f) of the invention and it is added to order to provide 100% by weight of the compositions of the invention. Desirably the compositions of the invention comprise at least about 80% water. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the aqueous compositions according to the invention.

The compositions of the invention are alkaline in nature, and the pH of the compositions of the invention are advantageously maintained within the range of from 7 to 10, but more desirably are to be maintained in the range of from 8–9.5, and most desirably from about 8.3–9.1. Such may be achieved and maintained by the use of appropriate pH adjusting agents such as are known to the art, examples of which are described in more particular detail below. The present inventors have noted that the maintenance of the pH within these ranges and in particular within the preferred ranges is particularly important in order to assure the phase stability of the aqueous compositions. It has been observed that this is particularly true where any fluoro-containing constituents are present as these are known to be difficult to solubilize in water, and more critically to maintain their solubility for extended periods of time. It has been observed that when such fluoro-containing constituents, particularly the fluorosurfactant composition, a fluoro-containing anti-resoiling agent such as the most preferred fluorinated acrylate copolymers, as well as further fluro-containing compounds precipitate from an aqueous composition that they are not readily reconstituted into such an aqueous composition by simple stirring or shaking, but need to be vigorously stirred or shaken in order to return to the solubilized state. The aqueous compositions being taught herein feature excellent stability which provides superior shelf stability and thus an extended service life for any commercial product based on the same. Such a feature is not provided or is not forseen from many known prior art compositions having fluoro-containing. Thus, the present inventive compositions represent a significant technical advantage thereover.

As has been previously noted, the compositions of the invention may include one or more optional constituents (g) many of which are recognized as conventional additives to such compositions. Such are generally present in only minor amounts, generally to comprise from about 0% wt.–5% wt. of the compositions of the invention.

The compositions according to the invention may also include minor amounts of one or more nonionic surfactant compounds included as an optional constituent (g), particularly alkoxylated aliphatic primary alcohols and alkoxylated aliphatic secondary alcohols. One or more nonionic surfactants may be used as well. Such include for example $C_8$–$C_{20}$ primary or secondary aliphatic alcohols condensed with from 2–10 moles of one or more alkylene oxides. Such alkylene oxides specifically include ethylene oxide, propylene oxide and butylene oxides, of which ethylene oxide, propylene oxide, or mixtures thereof are preferred, and further of which condensates containing only ethylene oxide as the alkoxyl moiety is most preferred.

Desirably the nonionic surfactant constituent, when present, is selected from alkoxylated $C_8$–$C_{15}$ primary aliphatic alcohols, and an alkoxylated $C_{10}$–$C_{15}$ secondary aliphatic alcohol in which ethylene oxide and/or propylene oxide represents the alkoxylate moiety of such surfactants.

Illustrative examples of these preferred water soluble nonionic ethoxylated phenols and/or ethoxylated alcohols surfactants include one or more of those available under the tradename of NEODOL®, presently commercially available from the Shell Oil Company; TERGITOL®, presently commercially available from Union Carbide, and POLYTERGENT®, presently commercially available from the Olin Chemical Co., IGEPAL® presently commercially available from the Rhône-Poulenc Co., as well as ethoxylated/propoxylated primary alcohols sold under the tradename PLURAFACS® and available from BASF Inc. Particular examples of such include NEODOL® 91-6 which is described as being a $C_9$–$C_{11}$ linear primary alcohol which includes 6 ethoxy groups per molecule, as well as TERGITOL® 15-S-9 which is described as being a $C_{11}$–$C_{15}$ secondary alcohol which includes 9 ethoxy groups per molecule. Further examples include POLYTERGENT® SL-62 which is described as being an alkoxylated linear aliphatic $C_8$–$C_{10}$ alcohol having a number of both ethoxy and propoxy groups per molecule, POLYTERGENT® SL-22 which is described as being an alkoxylated linear aliphatic $C_8$–$C_{10}$ alcohol having a number of both ethoxy and propoxy groups per molecule groups per molecule, as well as PLURAFACS® C-17 which is described as being a $C_{10}$–$C_{12}$ alkoxylated fatty alcohol. A particularly useful alkoxylated linear alcohol POLYTERGENT® SL-55 which is described as being a mixture of alkoxylated linear $C_8$–$C_{10}$ aliphatic alcohols.

Other known nonionic surfactants are contemplated as being useful in the compositions according to the present invention and these include alkoxylated alkyl aromatic compounds. Such compounds contain at least one aromatic moiety, such as a phenol, as well as an alkyl chain which may be straight chained or branched. Desirably the aromatic moiety is $C_5$–$C_7$, and particularly $C_6$ aromatic moieties are preferred, and wherein the alkyl chain is a $C_8$–$C_{20}$ alkyl group. The alkoxyl groups in such may be ethylene oxide, propylene oxide and butylene oxides, of which ethylene oxide, propylene oxide, or mixtures thereof are preferred, and further of which ethylene oxide is most preferred.

Such alkoxylated alkyl aromatic compounds are per se known to the art and are presently commercially available from a variety of sources including those sold under the tradename IGEPAL® and available from ISP Corporation (Wayne, N.J.) and TRITON® and available from Union Carbide Corp. (Danbury, Conn.). Particular examples of such include IGEPAL® CO-630 which is described as being a nonyl phenol ethoxylate, TRITON® X-100 described as being an isooctyl phenol ethoxylate and particularly IGEPAL® CA-210 described as being a $C_{10}$–$C_{12}$ ethoxylated octyl phenol with an average of 1.5 ethoxy groups per molecule.

The nonionic surfactant compositions desirably exhibit an HLB number in the range of from 4 to 20 and most desirably in the range of from 6 to 15.

In specific especially preferred embodiments of the present inventive compositions, the nonionic surfactant constituent includes or consists solely of a octylphenoxypolyethoxy ethanol such as may be commercially obtained as TRITON® X-100. The nonionic surfactant constituent, particularly the especially preferred octylphenoxypolyethoxy ethanol is generally included in minor amounts which on the one hand are sufficient to serve as a solubilizing adjuvant to any fragrance composition, and at the same time are not included in excessive amounts such that undesired resoiling of the treated fibers occurs. It has also been observed that excess amounts of the nonionic surfactant may also detract from the water repellency to be provided by the compositions, and thus in many instances the nonionic surfactant constituent is desirably omitted.

The nonionic surfactant compositions when included, are present in amounts of from 0.001% wt. to 0.5% wt., such recited weights being based on the weight of the actives in the nonionic surfactant composition.

The present inventors have unexpectedly observed that where a chelating agent is included in the inventive compositions, particularly where the chelating agent is a salt of ethylenediaminetetraacetic acid, that its inclusion lead to the manifestation of undesirable effects on treated substrates, particularly carpet surfaces. Such undesirable effects include a notable decrease in the water repellent characteristics of such treated substrates, as well as a total loss in the water repellent characteristics as well. Simultaneously, the inventors have also observed that the inclusion of ethylenediaminetetraacetic acid salts undesirably contribute to the corrosion of pressurized aerosol canisters. While not wishing to be bound by the following, it is nonetheless hypothesized that this behavior observed by the present inventors with respect to ethylenediaminetetraacetic acid salts as a chelating agent are believed to be equally applicable to other alkyl tetraaceticacid diamines and salts thereof.

With regard to the preservative ingredient of the liquid composition, since a significant portion of the formulation comprises water, it is preferably that the preservative be water soluble. Desirably, the selected water soluble preservatives are those which exhibit stability and efficacy in the aqueous compositions according to the invention at neutral, but preferably at alkaline pH's especially in the preferred pH ranges noted above. Such water soluble preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. For reasons of availability, the most preferred preservative are those commercially available preservative comprising a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEXTAMER® 38AD which is presently commercially available from Calgon Corp. (Pittsburgh, Pa.).

The compositions according to the invention optionally but desirably include an amount of a pH adjusting agent or pH buffer composition. Such compositions include many which are known to the art and which are conventionally used. By way of non-limiting example pH adjusting agents include phosphour containing compounds, monovalent and polyvalent salts such as of silicates, carbonates, and borates, certain acids and bases, tartarates and certain acetates. By way of further non-limiting example pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. Desirably the compositions according to the invention include an effective amounts of an organic acid and/or an inorganic salt form thereof which may be used to adjust and maintain the pH or the compositions of the invention to the desired pH range. Particularly useful is citric acid and sodium citrate which are widely available and which are effective in providing these pH adjustment and buffering effects.

Useful as optical brighteners are known optical brightening agents, including those based on stilbene derivatives and distyrylbiphenyl derivatives. Bleaching agents known to the art, including hydrogen peroxide may be used in the inventive compositions.

The compositions of the invention may also include a fragrance compositions or other composition for modifying the scent characteristics of the inventive compositions. Such may be any of a number of known materials, and generally too such are included in only minor amounts.

As a further optional constituent (g) the inclusion of amounts of a further flurorosurfactant composition different than that recited as constituent (a) is contemplated. Such may be desired in order to improve certain characteristics of the present inventive compositions. Such a further fluorosurfactant composition may be added in amounts which facilitate the oil repellent, viz., the oleophobic characteristics of substrates treated with the compositions being taught herein.

One such exemplary further fluorosurfactant composition is a perfluoropropionate according to the formula:

$$F(CF_2)_n—CH_2CH_2—S—CH_2CH_2—COO^-X^+ \quad (A)$$

where:

n is an integer having a value of 6 to 12; and, $X^+$ is a salt forming counterion, preferably lithium.

Another such exemplary further fluorosurfactant composition includes a perfluoroalkyl phosphate or salt thereof according to the formula:

$$CF_3—CF_2(CF_2CF_2)_n—CH_2CH_2—O—P(=O)(O^-)(O^-) \quad (B)$$

where:

n is an integer having a value of from 6 to 12.

These fluorosurfactant compositions according to formulae (A) and (B) may be used singly, or may be used in a mixture. When used as a mixture, desirably the weight ratio of the perfluoropropionate to the perfluoroalkyl phosphate is in the range of from about 1:1 to 1:2. Such a mixture is presently commercially available as ZONYL® 7950. Such fluorsurfactant compositions include those which are described in U.S. Pat. No. 5,439,610 to Ryan, et al., the contents of which are herein incorporated by reference.

Additional exemplary further fluorosurfactant compositions include materials are presently commercially available under the tradename ZONYL® from E.I. DuPont de Nemours Co. Exemplary materials include ZONYL® FSA which is described as being $F(CF_2CF_2)_{3-8}CH_2CH_2SCH_2CH_2CO_2Li$; ZONYL® FSP which is described as being $(F(CF_2CF_2)_{3-8}CH_2CH_2O)P(O)(ONH_4)_2$; ZONYL® FSE which is described as being $(F(CF_2CF_2)_{3-8}CH_2CH_2O)_2P(O)(ONH_4)_2$; ZONYL® UR which is described as being $(F(CF_2CF_2)_{3-8}CH_2CH_2O)P(O)(OH)_2$ as well as $(F(CF_2CF_2)_{3-8}CH_2CH_2O)_2P(O)(OH)$; ZONYL® FSJ which is described as being $(F(CF_2CF_2)_{3-8}CH_2CH_2O)P(O)(ONH_4)_2$ in conjunction with a nonfluorinated surfactant; ZONYL® FSN, ZONYL® FSN-100, ZONYL® FSO, and ZONYL® FSO-100, each of which may be commonly described as being $F(CF_2CF_2)_{3-8}CH_2CH_2O(CH_2CH_2O)_xH$; but differing in the value of x for each different composition; ZONYL® FSC which is described as being $F(CF_2CF_2)_{3-8}CH_2CH_2SCH_2CH_2N^+(CH_3)_3\ CH_3SO_4^-$; ZONYL® FSK which is described as being $F(CF_2CF_2)_{3-8}CH_2CH(OCOCH_3)CH_2N^+(CH_3)_2CH_2CO_2^-$; as well as ZONYL® TBS which is described as being $F(CF_2CF_2)_{3-8}CH_2CH_2SO_3H$ as well as $F(CF_2CF_2)_{3-8}CH_2CH_2SO_3NH_4$. Each of these materials may be used jointly such as in a mixture of two or more flurorosurfactants, or singly. Of these materials, those available as as ZONYL® 7950 are particularly preferred.

Such constituents as described above as essential and/or optional constituents include known art compositions, including those described in *McCutcheon's Emulsifiers and Detergents* (*Vol.* 1), *McCutcheon's Functional Materials* (*Vol.* 2), North American Edition, 1991; *Kirk-Othmer, Encyclopedia of Chemical Technology,* 3rd Ed., Vol. 22, pp. 346–387, the contents of which are herein incorporated by reference.

In a preferred embodiment of the invention there is provided a shelf stable, aqueous pourable and pumpable carpet cleaning and treatment composition which imparts oil and water repellency to treated surfaces which comprise, but more desirably consist essentially of the following constituents on a weight basis:

(a) 0.001–3% wt. fluoroaliphatic radical-containing poly (oxyalkylene) compound;

(b) 0.01–2% wt. an anti-resoiling compound;

(c) 0.001–2.5% wt. of an anionic surfactant compound, preferably one or more selected from alkyl sulfates, alkyl benzene sulfates, and alkane sulfonates as well as salts thereof;

(d) 0.001–7.0% wt. of an organic solvent;

(e) 0.01–0.3% wt. of a citric acid salt, preferably one or more anhydrous and dihydrous sodium citrates (f) at least 80% wt. of water which compositions of the invention are at a neutral or alkaline pH, desirably at a pH in the range of from 7 to 10, preferably at a pH in the range of from 8–9.5, and which may further contain 0–5% wt. of one or more conventional additives selected from:

(g) preservatives, coloring agents such as dyes and pigments, fragrances, pH adjusting agents, buffer compositions, further anti-soiling agents and resoiling inhibitors, optical brighteners, further solvents or surfactants particularly nonionic surfactant compounds, aerosol propellent compositions, as well as one or more further fluorosurfactant compositions.

It is to be understood that although the aqueous cleaning compositions taught herein have been generally discussed in conjunction with the cleaning of carpets and carpet fibers, it is nonetheless to be understood that they may be utilized in the cleaning of a wide variety of fibers and fibrous substrates including but not limited to those which comprise fibers which are made of naturally occurring or synthetically produced materials, as well as blends or mixtures of such materials. Substrates which can be treated in accordance with this invention are textile fibers or filaments, either prior to their use, or as used in fabricated fibrous articles such as fabrics and textiles, rugs, carpets, mats, screens, and the like. Articles produced from such textiles, such as garments and other articles of apparel such as scarves, gloves and the like may also be treated. Further, sporting goods such as hiking and camping equipment made from or with a fabric or textile may also be treated with the cleaning compositions being taught herein in order to clean and/or impart a degree of water and oil repellency thereto. The textiles and fabrics include those made with or of one or more naturally occurring fibers, such as cotton and wool, regenerated natural fibers including regenerated cellulose, and those made with or of synthetically produced fibers, such as polyamides, polyolefins, polyvinylidene chlorides, acetate, nylons, polyacrylics, rayon, and polyester fibers. Blends of two or more such fibrous materials are also expressly contemplated. Such textiles and fabrics may be woven, non-woven or knitted materials.

The compositions of the invention can be prepared in a conventional manner such as by simply mixing the constituents in order to form the ultimate aqueous cleaning composition. The order of addition is not critical. Desirably, and from all practicable purposes, it is advantageous that the constituents other than water be added to a proportion of the total amount of water then well mixed, and most desirably that the surfactants be first added to the volume of water, followed by any remaining ingredients especially the optional constituents, and that the fluorochemical be added last to ensure the best phase stability. Subsequently any remaining balance of water, if any should be required, is then added. Optionally, the pH adjusting agents and/or pH buffering compositions be added in a sufficient amount in order to bring the formed composition within the pH range desired following the final addition of any remaining balance of water, but they may also be added at any other step including in an addition step preceding the addition of the fluorochemical.

The compositions of this invention may be packaged in any suitable container. They may be pressurized and made available in this form by means of the addition of a suitable propellant to the composition. Any propellant which can self-pressurize the composition and serve as the means for dispensing it from its container is suitable, including liquified gaseous propellants or inert compressed gases. The preferred propellants are liquified, normally gaseous propellants such as the known hydrocarbon and halogenated hydrocarbon propellants. The preferred normally gaseous hydrocarbon propellants include the aliphatic saturated hydrocarbons such as propane, butane, isobutane, and isopentane; the preferred halogenated hydrocarbons include chlorodifluoromethane, difluoroethane dichlorodifluoromethane and the like. Mixtures of two or more propellants can be used. The propellant is desirably utilized in an amount sufficient to expel the entire contents of the containers. In general, the propellant will be from about 5% to about 25%, preferably about 5% to about 15% by weight of the total composition. Pressurized forms of the compositions will generally be expelled from the container in the form of a foam.

The compositions according to the invention may also be packaged in a conventional container which includes a fluid reservoir or bottle portion which is adapted for containing a quantity of the composition, and further includes a manually operable pump. Manual actuation of the pump acts to withdraw the composition from within the said fluid reservoir and deliver it through a nozzle to an area to be treated. Such are well known to the art. Most desirably, the compositions are packaged and provided in a container especially a pressurized vessel or a manually operable pump which induces foaming of the composition as it is dispensed from the container. Such per se, are known to the art.

The compositions according to the invention are used in a conventional manner in the cleaning of carpet surfaces. Generally, carpets are effectively cleaned by spraying about 5 grams per square foot of the carpeted surface with the aqueous cleaning composition and subsequently allowing said composition to penetrate amongst the carpet surface and the fibers. Desirably, this is further facilitated by the use of a manual agitation action, such as by rubbing an area of the carpet to be treated with a device such as a brush, sponge, mop, cloth, non-woven cloth, and the like until the aqueous cleaning composition is well intermixed amongst the carpet fibers. Where a carpet has an open pile, less manual agitation is usually required as opposed to carpets having closed loop piles wherein longer agitation and/or more vigorous agitation is generally required. This agitation may be repeated optionally by periodically rinsing the device in water and then reagitating and/or optionally reapplying an amount of the aqueous cleaning composition of the invention. This may continue until by visual inspection the soil is removed from the carpet surface to the cleaning device. Subsequently, the treated area is permitted to dry, which usually requires from as little as 20–30 minutes in areas of high heat and low humidity to as much as one or two hour and even longer such as in poorly heated and high humid locations. Generally, however, the drying period under typical conditions is between about 15 minutes to about 30 minutes. Optionally, but desirably, any remaining cleaning composition may be removed from the carpet such as by vacuuming in a conventional manner. In a further optional technique, the carpet may be brushed so to remove any residue of the aqueous cleaning composition from amongst the carpet fibers, and then vacuumed or brushed out from the carpeted area.

In contrast to many of the compositions known in the prior art, the aqueous cleaning compositions according to the present inventions surprisingly provide good cleaning efficacy, and simultaneously provide and/or restore to the treated carpet surface a degree of water and oil repellency, which are important in limiting the resoiling of the treated carpet surface. As had been noted previously, many known prior art compositions provide no restoration of either water or oil repellency to treated carpet surfaces, but are generally considered merely as cleaners, yet others may have imparting degree of water or oil repellency to a carpet surface, but not necessarily have provided any efficacious cleaning benefit. Thus, the compositions of the present invention provide these three simultaneous characteristics which are critical in maintaining the attractive appearance of carpeted surfaces, as well as concomitantly extending their useful service life.

EXAMPLES

The following examples illustrate the superior properties of the formulations of the invention and particular preferred embodiments of the inventive compositions. Exemplary formulations as illustrated on Table 1 wherein the weight percentages of each of the individual constituents are indicated and are based on the total weight of the composition of which it forms a part.

Exemplary formulations illustrating certain preferred embodiments of the inventive compositions and described in more detail in Table 1 below were formulated generally in accordance with the following protocol.

Into a suitably sized vessel, a measured amount of water was provided after which the constituents were added in the following sequence: surfactants and solvents, and lastly the fragrance constituents. All of the constituents were supplied at room temperature, and mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous.

It is to be noted that the constituents might be added in any order, but it is preferred that water be the initial constituent provided to a mixing vessel or apparatus as it is the major constituent and addition of the further constituents thereto is convenient.

TABLE 1

| | Ex. 1 | Ex. 2 | Ex. 3 | Ex. 4 | Ex. 5 | Ex. 6 | Ex. 7 | Ex. 8 |
|---|---|---|---|---|---|---|---|---|
| sodium citrate, anhy. | 0.100 | 0.100 | 0.100 | 0.100 | 0.100 | 0.100 | 0.100 | 0.100 |
| Stepanol WAC | — | — | — | — | — | — | — | 3.500 |

TABLE 1-continued

| | | | | | | | | |
|---|---|---|---|---|---|---|---|---|
| anionic sulfosuccinate blend | 3.500 | 3.500 | 3.500 | 3.500 | 3.500 | 3.500 | 3.500 | — |
| Syntran 1575 | 6.250 | 6.250 | 6.250 | 6.250 | 6.250 | 6.250 | 6.250 | 6.250 |
| isopropylalcohol | 2.000 | 2.000 | 2.000 | 2.000 | 2.000 | 2.000 | 2.000 | 2.000 |
| Hexyl Cellosolve | 1.250 | 1.250 | 1.250 | 1.250 | 1.250 | 1.250 | 1.250 | 1.250 |
| Fluorad FC-138 | 1.500 | 1.500 | 1.500 | 1.500 | 1.500 | 1.500 | 1.500 | 1.500 |
| NH4OH | 0.005 | 0.005 | 0.005 | 0.005 | 0.005 | 0.005 | 0.005 | 0.027 |
| sodium bicarbonate | — | — | — | — | — | — | — | — |
| sodium nitrite | 0.100 | 0.100 | 0.100 | 0.100 | 0.100 | 0.100 | 0.100 | 0.100 |
| sodium benzoate | — | — | — | — | — | — | — | — |
| fragrance A | — | — | 0.200 | — | 0.200 | 0.200 | — | — |
| fragrance B | — | — | — | 0.200 | — | — | 0.200 | 0.200 |
| Kathon CG/ICP II | 0.050 | — | — | — | 0.050 | — | — | 0.050 |
| Proxel GXL | — | 0.100 | — | — | — | 0.100 | 0.100 | — |
| DI Water | 85.245 | 85.195 | 85.095 | 85.095 | 85.045 | 84.995 | 85.995 | 85.023 |

| | Ex. 9 | Ex. 10 | Ex. 11 | Ex. 12 | Ex. 13 | Ex. 14 | Ex. 15 |
|---|---|---|---|---|---|---|---|
| sodium citrate, anhy. | 0.100 | 0.100 | 0.100 | 0.100 | 0.100 | 0.100 | 0.100 |
| Stepanol WAC | — | — | — | — | — | — | 3.500 |
| anionic sulfosuccinate blend | 3.500 | 3.500 | 3.500 | 3.500 | 3.500 | 3.500 | — |
| Syntran 1575 | 6.250 | 6.250 | 6.250 | 6.250 | 6.250 | 6.250 | — |
| isopropylalcohol | 2.000 | 2.000 | 2.000 | 2.000 | 2.000 | 2.000 | 2.000 |
| Hexyl Cellosolve | 1.250 | 1.250 | 1.250 | 1.250 | 1.250 | 1.250 | 1.250 |
| Fluorad FC-138 | 1.500 | 1.500 | 1.500 | 1.500 | 1.500 | 1.500 | 1.500 |
| NH4OH | 0.005 | 0.005 | 0.005 | — | 0.005 | 0.000 | — |
| sodium bicarbonate | — | — | — | 0.010 | — | — | — |
| sodium nitrite | 0.200 | 0.100 | — | 0.100 | 0.100 | 0.100 | 0.100 |
| sodium benzoate | — | 0.100 | 0.200 | — | — | — | — |
| fragrance A | — | — | — | — | — | — | — |
| fragrance B | 0.200 | 0.200 | 0.200 | 0.200 | 0.200 | 0.200 | 0.200 |
| Kathon CG/ICP II | 0.050 | 0.050 | 0.050 | 0.050 | 0.050 | 0.050 | 0.050 |
| Proxel GXL | — | — | — | — | — | — | — |
| DI Water | 84.945 | 84.945 | 84.945 | 85.040 | 85.045 | 85.050 | 91.300 |

Table 1 illustrates the actual weight of the constituent added to form a respective exemplary formulation. The identity of the constituents used to form the example formulations, and (where relevant) the weight percent of the actives in a respective constituent, are specifically identified on Table 2 following.

TABLE 2

| CONSTITUENT LISTING | |
|---|---|
| Stepanol ® WAC | anionic surfactant composition based on sodium lauryl sulfate, features low chloride content (30% wt. actives) |
| anionic sulfosuccinate blend | blend of disodium monolauryl sulfosuccinate and disodium docoamido methylisopropanol amide sulfosuccinate (30% wt. actives) |
| Fluorad ® FC-138 (30%) | fluoroaliphatic radical-containing poly(oxyalkylene) compound containing composition (30% wt. actives) |
| Syntran ® 1575 (20%) | Syntran ® 1575 (20% wt. actives), fluorinated acrylic polymer salt |
| isopropylalcohol | isopropylalcohol |
| Hexyl Cellosolve ® | ethylene glycol hexyl ether, organic solvent |
| NH4OH | ammonium hydroxide (28% wt. actives) |
| sodium citrate, anh. | sodium citrate, anhydrous |
| sodium benzoate | corrosion inhibitor |
| sodium nitrite | corrosion inhibitor |
| Fragrance A | proprietary fragrance composition |
| Fragrance B | proprietary fragrance composition |
| Proxel GXL | proprietary preservative composition |
| Kathon ® CG/ICP II | Kathon ® CG/ICP II, proprietary preservative composition |
| DI Water | deionized water |

Characteristics of the formulations according to the Examples were evaluated in accordance with one or more of the following test protocols.

The repellency characteristics of compositions according to the invention were evaluated, as described hereinafter. Carpet swatches approximately 5 inches by 5 inches made of a light beige colored level loop nylon carpeting were used as a standard testing substrate. Such carpet swatches are similar to those presently commercially available as DuPont® Stainmaster® carpets from a variety of commercial source, but differed from those commercially available as they were produced without any fluorochemical fiber or surface treatments. Such standard testing substrates were used in the following evaluations of oil repellency, water repellency, beverage repellency and motor oil repellency described below.

Oil Repellency

Oil repellency characteristics of sample carpet swatches were evaluated generally in accordance with the following protocol. For this test, carpet swatch approximately 5 inches by 5 inches made of a light beige colored level loop nylon carpeting formed the standard testing substrate. Such carpet swatches are similar to those presently commercially available as DuPont® Stainmaster® carpets from a variety of commercial source, but differed from those commercially available as well as those described previously as they were produced without any fluorochemical fiber or surface treatments.

In the performance of the oil repellency testing, standardized oil compositions were utilized which are identified as follows the following: Oil #1 was a composition consisting solely of mineral oil; Oil #2 was a composition comprising 65 parts by weight mineral oil and 35 parts by weight hexadecane; Oil #3 consisted essentially of hexadecane; Oil #4 consisted essentially of tetradecane; and the last standardized Oil #5 consisted essentially of dodecane.

Clean, light beige colored sample carpet swatches of the same size and type as those used in the cleaning evaluations denoted above were treated with one of the formulations recited on Table 1. In the performance of the test a 15–20 gram amount of a single formulation was dispensed to the surface of the carpet swatch with the use of a manually pumpable trigger spray dispenser and thereafter rubbed into and amongst the carpet fibers for 30 seconds, in a manner to adequately cover the entire surface of the sample carpet swatch.

Subsequently, the standardized oils were used in rising numerical sequence in order to evaluate the oil repellent characteristics imparted to the treated carpet swatches. Beginning with Oil #1, a drop of said oil was placed upon the surface of the carpet fiber and it was observed carefully. If the oil droplet maintained a bead on the carpet surface for 30 seconds, this treated carpet swatch was judged to have a rating of at least "1". The protocol was repeated in a different part of the carpet utilizing the next numerically higher oil number, in this case, Oil #2. Again, if the oil droplet maintained a bead on the carpet surface for 30 seconds, this treated carpet swatch was judged to have a rating of at least "2". This protocol was repeated using in sequence standardized oils #3, #4 and #5 until a standardized oil failed to maintain its bead upon the surface of the carpet for the 30 second period noted above. If the bead of a particular standardized oil was observed to be partially but not totally absorbed by the carpet swatch, or to slump in its appearance during the 30 second interval, then a value of "0.5" was added to the prior number of the standardized oil which maintained a droplet bead on the carpet surface for 30 seconds, and this number was reported. Otherwise, the highest numbered standardized oil which did maintain its bead upon the surface during the 30 second interval was reported on Table 3 following.

This testing protocol was repeated for each of the formulations on Table 1.

Water Repellency

Water repellency characteristics of sample carpet swatches were evaluated generally in accordance with the following protocol.

In the performance of the water repellency characteristics, standardized water compositions were utilized which may be generally characterized as the following: the standardized water #1 was a sample comprising deionized water and 2% weight isopropyl alcohol; standardized water #2 was deionized water comprising 5% isopropyl alcohol; standardized water #3 consisted of deionized water comprising 10% by weight isopropyl alcohol; standardized water #4 consisted essentially of deionized water with 20% by weight isopropyl alcohol; and standardized water #5 comprised 30% by weight isopropyl alcohol with deionized water.

Clean, light beige colored sample carpet swatches of the same size and type as those used in the and oil repellency evaluations as described above were treated with one of the formulations recited on Table 1. In the performance of the test a 15–20 gram amount of a single formulation was dispensed to the surface of the carpet swatch with the use of a manually pumpable trigger spray dispenser and thereafter rubbed into and amongst the carpet fibers for 30 seconds, in a manner to adequately cover the entire surface of the sample carpet swatch.

Subsequently, the standardized water samples were used in rising numerical sequence in order to evaluate the water repellent characteristics imparted to the treated carpet swatches. Generally, and beginning with standardized water #1, a drop of said water was placed upon the surface of the carpet fiber and it was observed carefully. If the water droplet maintained a bead on the carpet surface for 10 seconds, this treated carpet swatch was judged to have a rating of at least "1". The protocol was repeated in a different part of the carpet utilizing the next numerically higher water number, in this case, standardized water #2. Again, if the water droplet maintained a bead on the carpet surface for 10 seconds, this treated carpet swatch was judged to have a rating of at least "2". This protocol was repeated using in sequence standardized waters #3, #4 and #5 until a standardized water failed to maintain its bead upon the surface of the carpet for the 10 second period noted above. If the bead of a particular standardized water was observed to be partially but not totally absorbed by the carpet swatch, or to slump in its appearance during the 10 second interval, then a value of "0.5" was added to the prior number of the standardized water which maintained a droplet bead on the carpet surface for 10 seconds, and this number was reported. Otherwise, the highest numbered standardized water which maintained its bead upon the surface during the 10 second interval was reported on Table 3 following.

This testing protocol was repeated for each of the formulations on Table 1.

TABLE 3

| | REPELLENCY | |
|---|---|---|
| | Oil | Water |
| Ex. 1 | — | — |
| Ex. 2 | — | — |
| Ex. 3 | — | — |
| Ex. 4 | — | — |
| Ex. 5 | 2.5 | 4.0 |
| Ex. 6 | 2.5 | 4.0 |
| Ex. 7 | 2.5 | 4.0 |
| Ex. 8 | 3.5 | 2.5 |
| Ex. 9 | — | — |
| Ex. 10 | — | — |
| Ex. 11 | — | — |
| Ex. 12 | 2.5 | 4.0 |
| Ex. 13 | 2.5 | 4.0 |
| Ex. 14 | 4.0 | 4.0 |
| Ex. 15 | 3.0 | 2.0 |

"—" indicates that the sample was not tested

As may be readily determined from the results illustrated on Table 3, the tested formulations, exhibit good water and oil repellency characteristics. It is to be noted that in evaluating the overall performance of a particular formulation attention is to be directed not only to the fact that it may provide good water and oil repellent characteristics to a substrate being treated but further, attention is to be directed to the cleaning characteristics which are exhibited by a particular composition as well such that a satisfactory product based on a formulation desirably exhibits good water and oil repellency characteristics and concurrently also exhibits excellent cleaning characteristics as well.

Beverage Repellency

In order to provide an indicator of the characteristics of the repellency imparted to a sample carpet in a setting more approximate to a consumer or end-user environment, a beverage repellency test was performed. The beverage used was a widely available sweetened beverage, Kool-Aid® Cherry Flavor which was prepared in accordance with label directions. Such beverage included a significant proportion of sugar and/or an artificial sweetening composition either, as well as a known difficult to remove food grade dye as a coloring agent, each of which are are known to be difficult to remove.

According to the test, a sample carpet swatch treated with a formulation according to Table 1 is evaluated by placing one (or more) drops of the beverage on the surface of the treated swatch and the rate at which the beverage is absorbed into the carpet is indicated.

The results of such test are indicated on Table 4, below.

TABLE 4

| BEVERAGE REPELLENCY | |
|---|---|
| | observations |
| Ex. 1 | — |
| Ex. 2 | — |
| Ex. 3 | — |
| Ex. 4 | — |
| Ex. 5 | good after 30 minutes |
| Ex. 6 | good after 30 minutes |
| Ex. 7 | good after 30 minutes |
| Ex. 8 | good after 30 minutes |
| Ex. 9 | — |
| Ex. 10 | — |
| Ex. 11 | — |
| Ex. 12 | good after 15 minutes |
| Ex. 13 | good after 30 minutes |
| Ex. 14 | good after 60 minutes |
| Ex. 15 | good after 30 minutes |

"—" indicates that the sample was not tested

Motor Oil Repellency

In order to provide a further indicator of the characteristics of the repellency imparted to a sample carpet in a setting more approximate to a consumer or end-user environment, a motor oil repellency test was performed. The motor oil used in the test was a used automotive grade motoro oil. Such are known to be greenish-brown in color, viscous and notorious in both their staining ability, as well as the difficulty associated in removing them from fibers, especially carpet surfaces. According to the test, a sample carpet swatch treated with a formulation according to Table 1 is evaluated by placing one (or more) drops of the motor oil on the surface of the treated swatch and the rate at which the motor oil is absorbed into the carpet is indicated.

The results of such test are indicated on Table 5, following.

TABLE 5

| MOTOR OIL REPELLENCY | |
|---|---|
| | observations |
| Ex. 1 | — |
| Ex. 2 | — |
| Ex. 3 | — |
| Ex. 4 | — |
| Ex. 5 | good after 30 minutes |
| Ex. 6 | good after 30 minutes |
| Ex. 7 | good after 30 minutes |
| Ex. 8 | good after 20 minutes |
| Ex. 9 | — |
| Ex. 10 | — |
| Ex. 11 | — |
| Ex. 12 | good after 30 minutes |
| Ex. 13 | good after 30 minutes |
| Ex. 14 | good after 60 minutes |
| Ex. 15 | good after 30 minutes |

"—" indicates that the sample was not tested

As may be seen from the above results indicated on Tables 4 and 5, the formulations according to the invention impart excellent water and oil repellency to carpet fibers, particularly with regard to the sweetened beverage compositions and used motor oil compositions which are known to be notororiously difficult to remove from carpet fibers.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

We claim:

1. Aqueous carpet cleaning and surface treatment compositions for imparting oil and water repellency to treated surfaces, the compositions comprising:

(a) a fluoroaliphatic radical-containing poly(oxyalkylene) compound;

(b) an anti-resoiling composition selected from the group consisting of polyacrylates, polycarboxylates, cationic amines, aliphatic quaternary ammonium salts having anti-static properties, and imidazoline salts;

(c) an anionic surfactant compound;

(d) organic solvent;

(e) citric acid salts; and (f) water wherein the composition is at a pH from 7–10.

2. The composition according to claim 1 wherein:

constituent (a) is a fluoroaliphatic oligomer or which may be represented by the general formule:

$$(R_f)_sZ[(R^3)_yZ'B]_t \quad (1)$$

$$[(R_f)_sZ[(R^3)_yZ'B']_t]_w \quad (2)$$

where $R_f$ is a fluoroaliphatic radical,

Z is a linkage through which $R_f$ and $(R^3)_y$ moieties are covalently bonded together, $(R^3)_y$ is a poly(oxyalkylene) moiety, $R^3$ being an oxyalkylene group with 2 to 4 carbon atoms and y is an integer (where the above formulas are those of individual compounds) or a number (where the above formulas are those of mixtures) at least 1, preferably 1 to 125 and can be as high as 180 or higher, B is a hydrogen atom or a monovalent terminal organic radical, B' is B or a valence bond, with the proviso that at least one B' is a valence bond interconnecting a Z-bonded $R^3$ radical to another Z, Z' is a linkage through which B, or B', and $R^3$ are covalently bonded together, s is an integer or number of at least 1 and can be as high as 25 or higher, t is an integer or number of at least 1, and can be as high as 60 or higher, and w is an integer or number greater than 1, and can be as high as 30 or higher.

3. The composition according to claim 1 wherein:

constituent (a) is a fluorochemical salt according to the general structure:

$$C_8F_{17}N(CH_3)(CH_2)_3(A)_nOSO_2^-X^+$$

in which n represents a value of between 1 and 3, preferably is a value of from 1 to 2 inclusive, and most preferably is a value of about 1.5;

A represents an ethoxy ($OC_2H_4$) group, propoxy ($OC_3H_6$) group, or is a mixture of both ethoxy and propoxy groups; and, $X^+$ is a salt forming counterion.

4. The composition according to claim 1 wherein:

the fluoroaliphatic radical-containing poly(oxyalkylene) compound according to constituent (a) is present in an amount of from between about 0.001% wt. and about 3% wt.

5. The composition according to claim 4 wherein:

the fluoroaliphatic radical-containing poly(oxyalkylene) compound according to constituent (a) is present in an amount of from between about 1.4% wt. and about 2.0% wt.

6. The composition according to claim 1 wherein:

constituent (b) is present in an amount of from about 0.01% wt. to about 11.0% wt.

7. The composition according to claim 1 wherein:

constituent (c) is an anionic surfactant compound selected from alkyl sulfates, alkyl benzene sulfates, and alkane sulfonates or salt forms thereof.

8. The composition according to claim 1 wherein:

constituent (c) is present in an amount of from 0.001–2.5% wt.

9. The composition according to claim 1 wherein:

constituent (d) is one or more organic solvents selected from: alcohols, glycols, acetates, ether acetates and glycol ethers.

10. The composition according to claim 1 wherein:

constituent (d) is present in an amount of from about 0.001% wt. to about 7.0% wt.

11. The composition according to claim 1 wherein:

constituent (e) is one or more anhydrous or dihydrous citric acid salts.

12. The composition according to claim 1 wherein:

constituent (f) is present in an amount of at least about 80% wt.

13. The composition according to claim 1 which further comprises:

0–5% wt. of one or more conventional additives selected from: preservatives, coloring agents such as dyes and pigments, fragrances, pH adjusting agents, buffer compositions, further anti-soiling agents and resoiling inhibitors, optical brighteners, further solvents or surfactants particularly non-ionic surfactant compounds, aerosol propellent compositions, as well as one or more further fluorosurfactant compositions.

14. A composition according to claim 13 which comprises one or more nonionic surfactant compounds.

15. A composition according to claim 14 which comprises a perfluoropropionate according to the formula:

$$F(CF_2)_n—CH_2CH_2—S—CH_2CH_2—COO^-X^+ \quad (A)$$

where:

n is an integer having a value of 6 to 12; and, $X^+$ is a salt forming counterion.

16. A composition according to claim 14 which comprises a perfluoroalkyl phosphate or salt according to the formula:

$$CF_3—CF_2(CF_2CF_2)_n—CH_2CH_2—O—P(=O)(O^-)_2 \quad (B)$$

where:

n is an integer having a value of from 6 to 12.

17. A shelf stable composition according to claim 1 when packaged in conventional pressurized aerosol containers and subjected to accelerated ageing testing at 120 deg. F., for a four-week test period are phase stable.

18. An aqueous carpet cleaning and surface treatment compositions for imparting oil and water repellency to treated surfaces according to claim 1 which comprise:

(a) fluoroaliphatic radical-containing poly(oxyalkylene) compound;

(b) an anti-resoiling composition selected from:

a fluorinated acrylate copolymer is according to the formula:

$$CF_3(CF_2)_nCH_2OCOC(CH_3)=CH_2$$

wherein n represents a value of from 6–8, and, a non-halogenated acrylic polymer according to the formula:

$$\left(CH_2—CH(COOR)\right)_n$$

wherein n is a value greater than 50;

(c) anionic surfactant compound;

(d) organic solvent;

(e) citric acid salts;

(f) water wherein the composition is at a pH from 7–10.

19. A composition according to claim 18 which further comprises a perfluoropropionate according to the formula:

$$F(CF_2)_n—CH_2CH_2—S—CH_2CH_2—COO^-X^+ \quad (A)$$

where:

n is an integer having a value of 6 to 12; and, $X^+$ is a salt forming counterion.

20. A composition according to claim 18 which further comprises a perfluoroalkyl phosphate or salt according to the formula:

$$CF_3—CF_2(CF_2CF_2)_n—CH_2CH_2—O—P(=O)(O^-)_2 \quad (B$$

where:

n is an integer having a value of from 6 to 12.

21. A composition according to claim 1 consisting essentially of the following constituents on a weight basis:

(a) 0.001–3% wt. fluoroaliphatic radical-containing poly (oxyalkylene) compound;

(b) 0.01–2% wt. an anti-resoiling compound;

(c) 0.001–2.5% wt. of an anionic surfactant compound, preferably one or more selected from alkyl sulfates, alkyl benzene sulfates, and alkane sulfonates as well as salts thereof;

(d) 0.001–7.0% wt. of an organic solvent;

(e) 0.01–0.3% wt. of a citric acid salt, preferably one or more anhydrous and dihydrous sodium citrates (f) at least 80% wt. of water (g) 0–5% of one or more conventional additives selected from: preservatives, coloring agents such as dyes and pigments, fragrances, pH adjusting agents, buffer compositions, further anti-soiling agents and resoiling inhibitors, optical brighteners, further solvents or surfactants particularly non-ionic surfactant compounds, aerosol propellent compositions, as well as one or more further fluorosurfactant compositions, wherein the composition is at a pH from 7–10.

22. The composition according to claim 21 wherein the anti-resoiling composition is selected from:

a fluorinated acrylate copolymer is according to the formula:

$$CF_3(CF_2)_nCH_2OCOC(CH_3)=CH_2$$

wherein n represents a value of from 6–8, and, a non-halogenated acrylic polymer according to the formula:

$$\left(CH_2-CH(COOR)\right)_n$$

wherein n is a value greater than 50.

23. Aqueous carpet cleaning and surface treatment compositions according to claim 1, wherein the composition is substantially free of alkylenediaminetetraacetic acid chelating agents or salts thereof.

* * * * *

UNITED STATES PATENT AND TRADEMARK OFFICE

CERTIFICATE OF CORRECTION

PATENT NO. : 5,861,365

DATED : 19 January 1999

INVENTOR(S) : Andrew Francis COLURCIELLO, Jr. et al.

It is certified that error appears in the above-identified patent and that said Letters Patent is hereby corrected as shown below:

On the cover page, at "[56] Foreign Patent Documents", at the top of the second column, line 2, after "0 803 567 A2 10/1997" delete "WIPO" and insert --European Pat. Off.--.

Signed and Sealed this

First Day of June, 1999

*Attest:*

Q. TODD DICKINSON

*Attesting Officer*

*Acting Commissioner of Patents and Trademarks*